United States Patent [19]

Yu

[11] Patent Number: 4,834,251

[45] Date of Patent: May 30, 1989

[54] CHILD-PROOF MEASURING CUP

[76] Inventor: Hon T. Yu, 680 Manhattan Ave., Apt. #18, Brooklyn, N.Y. 11222

[21] Appl. No.: 146,562

[22] Filed: Jan. 21, 1988

[51] Int. Cl.[4] ..... B65D 55/02

[52] U.S. Cl. ..... 215/222; 215/330; 215/DIG. 7

[58] Field of Search ..... 215/204, 218, 222, 352, 215/DIG. 7, 330

[56] References Cited

U.S. PATENT DOCUMENTS

| | | | |
|---|---|---|---|
| 2,647,652 | 8/1953 | Sanford | 215/352 X |
| 3,227,301 | 1/1966 | Cornelius | 215/DIG. 7 |
| 4,230,230 | 10/1980 | Mumford | 215/DIG. 7 |
| 4,399,920 | 8/1983 | Swartzbaugh et al. | 215/222 X |
| 4,627,547 | 12/1986 | Cooke | 215/222 |

FOREIGN PATENT DOCUMENTS

| | | | |
|---|---|---|---|
| 576029 | 3/1946 | United Kingdom | 215/DIG. 7 |
| 2182648 | 5/1987 | United Kingdom | 215/204 |

*Primary Examiner*—William A. Cuchlinski, Jr.
*Attorney, Agent, or Firm*—Richard L. Miller

[57] ABSTRACT

This child-proof measuring cup is a cup and bottle combination for helping to prevent a child from separating the assembly. Primarily, it consists of a tapered bottle and a tapered measuring cup that lock together by projections formed on the cup and the neck of the bottle, and convex portion of the bottom of the cup on its interior, serves to aid in pushing down against the screw cap of the bottle to form a locking of the assembly.

5 Claims, 1 Drawing Sheet

CHILD-PROOF MEASURING CUP

BACKGROUND OF THE INVENTION

The instant invention relates generally to medicine bottles, and more particularly, to a child-proof measuring cup.

Numerous bottles and cup combinations have been provided in the prior art that are adapted to prevent unauthorized access to the contents thereof. For example, U.S. Pat. Nos. 3,984,021 of Uhlig; 2,448,893 of Lamar; and 1,280,700 of Fouche, all are illustrative of such prior art. While these units may be suitable for the particular purpose to which they address, they would not be as suitable for the purpose of the present invention as hereafter described.

SUMMARY OF THE INVENTION

A primary object of the present invention is to provide a child-proof measuring cup that will overcome the shortcomings of the prior art devices.

Another object is to provide a child-proof measuring cup that serves to prevent a child from opening as screw type cap from a medicine bottle through the employment of a measuring cup.

An additional object is to provide a child-proof measuring cup that will employ positive locking devices.

A further object is to provide a child-proof measuring cup that is simple and easy to use.

A still further object is to provide a child-proof measuring cup that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
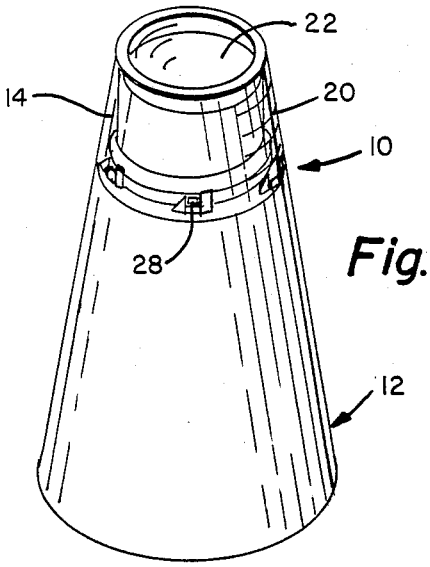
FIG. 1 is a perspective view of the instant invention.
Figure 4:
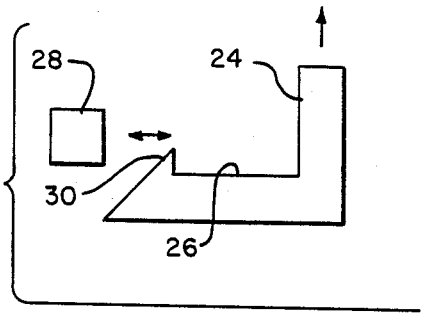
FIG. 4 is a diagrammatic side view showing the locking mechanism.
Figure 2:
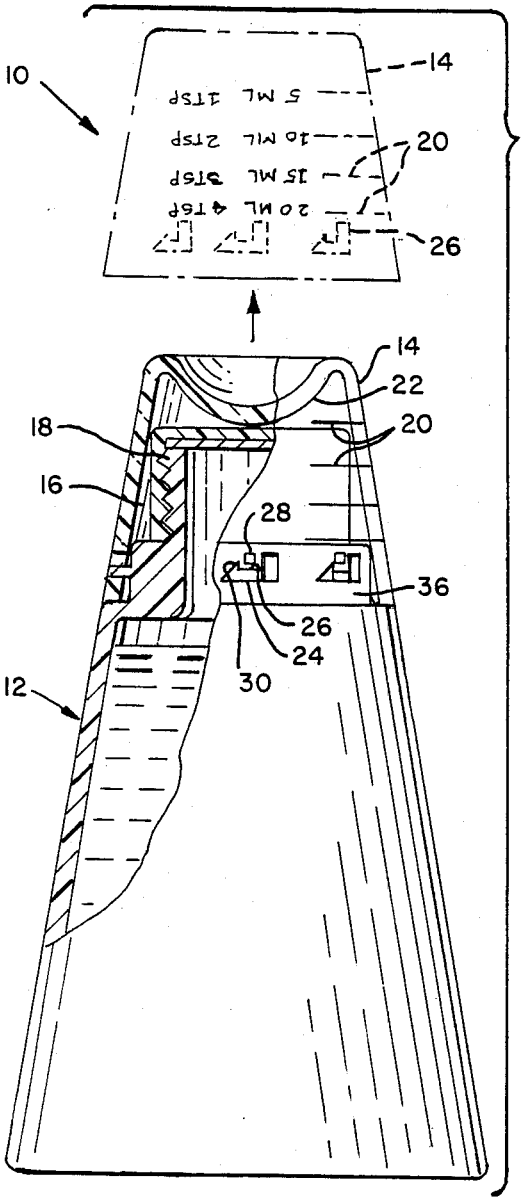
FIG. 2 is an enlarges vertical elevational view of the invention shown partly broken away with the measuring cup illustrated in phantom as removed therefrom.

Turning now descriptively to the drawings, in which like reference characters denote like elements throughout the several views, FIGS. 1 through 4 illustrate an assembly 10 shown to include a bottle 12 preferably made of plastic material and is tapered towards its top end, so as to deter a child from easily picking it up to remove the measuring cup 14 therefrom, and then remove the cap 16 and have access to the contents of bottle 12.

The cap 16 threads down on the bottle neck 18 in a normal manner and the measuring cup 14 is inscribed with increments 20 of fluid measurement in this instant and recessed portion 22 in the top of cup 14, provides for engagement with the top of cap 16 for securing a tight closed fit, in a manner which hereinafter will be described. The advantage of the cup 14 is it will enable a patient to pour the exact measurement of their medicine 24 without the use of different size spoons.

Raised portions 24 are equally and radially spaced apart on the interior surface of cup 14 near the bottom edge, and an opening 26 in the bottom portion of the raised portions 24, is designed to receive the similarly radially spaced projections 28 projecting from the flange 36 when cup 14 is received on bottle 12 and is pressed downward and rotated.

In use, cup 14 is placed on top of the bottle 12 and is urged downward and rotated at the same time in a clock-wise direction. When doing so, the recessed portion 22 engages with the top of the cap 16. When the hook portion 30 cams under the projection 28 after alignment, pressure upon cup 14 is released and cup 14 is prevented from rotation and removal, because the projection 28 is residing in the opening 26. In effecting an authorized opening of bottle 12, the reverse procedure is executed, meaning, pressure upon the cup 14 and counter rotation of the cup 14.

Figure 3:
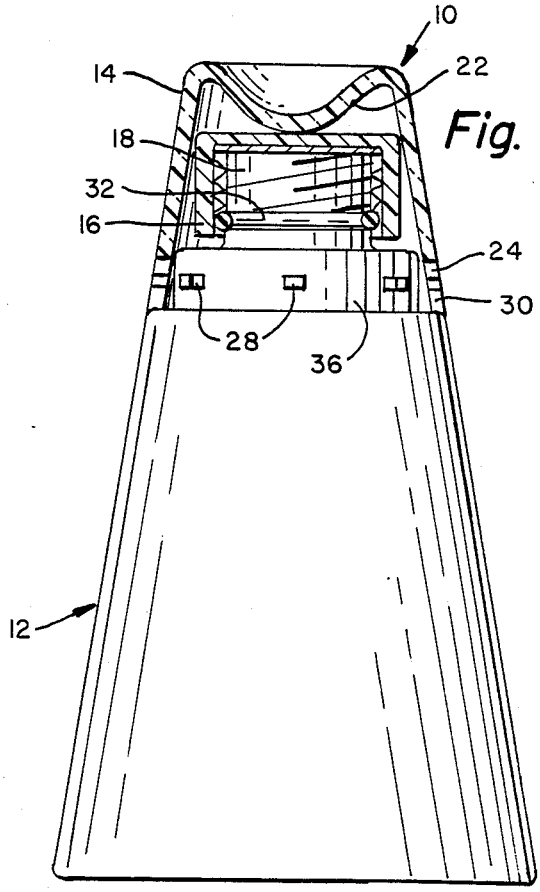
FIG. 3 is a modified form of the invention shown partly broken away and illustrating a rubber O-ring seal.

Referring now to FIG. 3 of the drawing, assembly 10 is modified to have an O-ring 32 received in an annular groove now provided in the outer periphery of bottle neck 18. This arrangement provides that the user may adjust the required amount of hold down pressure depending upon how far cap 16 is first thread on neck 18, while still preventing the contents of bottle 12 from being spilled therefrom.

In operative use naturally screwing the cap 16 on neck 18 only slightly will require that greater hold down pressure will be required to release projections 28 from openings 26, than had the cap been otherwise completely screwed on neck 18.

This greater hold-down pressure is required because recessed portion 22 engages with the top cap 16 before cup 14 can be inserted far on the flange 36 of bottle 12.

In use, the assembly 10 as modified in FIG. 3, functions in the same manner described, with the exception, that greater downward pressure can be required.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A child proof container comprising, a bottle, a cap received on the bottle, means for positioning the cap at various heights on the bottle with the heights representing amounts of closure of the cap onto the bottle, and a measuring cup for locking onto the bottle and covering the cap, a recessed portion depending from said cup for engaging onto the cap and applying hold down pressure onto the cap, whereby the amount of hold down pressure will depend on the amount of closure of the cap onto the bottle to prevent the contents of the bottom from being spilled out, wherein said bottle comprises a neck base portion at an upper end and further comprising a locking assembly between said neck base portion and said cup, said locking assembly comprising a plurality of circumferentially spaced apart projections radially projecting from an outer periphery of said neck base portion, and a corresponding plurality of substantially L-shaped projections radially projecting from a periphery of said cup.

2. A child proof container as in claim 1, wherein said L-shaped projections include a forward cam surface and an elongated seat behind said cam portion whereupon rotational locking of the cup onto the bottle said cam portion is urged against the projections on said neck base and catches said projections onto said seats forcing said cup downward into a locking position and causing said recessed portion to apply pressure on the cap.

3. A child proof container as in claim 2, and comprising screw threads between said cap and said bottle.

4. A child proof container as in claim 3, and further comprising an annular groove about the periphery of said neck base portion and said o-ring in said annular groove.

5. A child proof container as in claim 2, wherein said bottle is tapered to prevent easy grasping of said bottle and said cup is correspondingly tapered to provide a continuous smooth surface when locked onto the bottle.

* * * * *